United States Patent [19]

Rundkvist et al.

[11] 4,073,446

[45] Feb. 14, 1978

[54] INERTIA CONE CRUSHER

[76] Inventors: Konstantin Alexandrovich Rundkvist, Shkolnaya ulitsa, 6, kv. 23; Nikolai Alexeevich Ivanov, Novoizmailovsky prospekt, 19, kv. 96; Boris Gavrilovich Ivanov, Basseinaya ulitsa, 5, kv. 18; Leonid Petrovich Zarogatsky, Uglovoi pereulok, 5, kv. 21; Evgeny Sergeevich Mitrofanov, ulitsa Sedova, 69, kv. 30; Ilya Izrailevich Blekhman, prospekt Kosmonavtov, 46, korpus 1, kv. 194, all of Leningrad, U.S.S.R.

[21] Appl. No.: 714,257

[22] Filed: Aug. 13, 1976

[30] Foreign Application Priority Data

Sept. 23, 1975 U.S.S.R. ..... 1422777

[51] Int. Cl.[2] ..... B02C 2/04

[52] U.S. Cl. ..... 241/207; 241/210

[58] Field of Search ..... 241/207–216

[56] References Cited

U.S. PATENT DOCUMENTS

| | | | |
|---|---|---|---|
| 566,088 | 8/1896 | McCully | 241/216 X |
| 1,553,333 | 9/1925 | Sholl et al. | 241/210 |
| 2,184,214 | 12/1939 | Ellis | 241/210 X |
| 3,908,916 | 9/1975 | Klushantsev et al. | 241/214 X |

FOREIGN PATENT DOCUMENTS

| | | | |
|---|---|---|---|
| 47-1256 | 5/1972 | Japan | 241/210 |

*Primary Examiner*—Roy Lake
*Assistant Examiner*—Howard N. Goldberg
*Attorney, Agent, or Firm*—Lackenbach, Lilling & Siegel

[57] ABSTRACT

The inertia cone crusher comprises a shell interconnected through vibration dampers to a crusher base and the shell carrying a crushing bowl which accommodates a breaking head. The shaft of the breaking head carrying an out-of-balance weight having its own rotation drive and axial support. The crusher shell also accommodates a countershaft which is a component of the out-of-balance weight drive. The shaft with one of its ends is movably connected (both axially and radially) to the driving member of the out-of-balance weight drive, whereas the other end of the countershaft is connected to the out-of-balance weight through an axially fixed ball spindle, whereby the latter serves as an axial support for the out-of-balance weight.

4 Claims, 4 Drawing Figures

INERTIA CONE CRUSHER

The invention generally relates to cone crushers for disintegrating various materials and more specifically, to inertia cone crushers.

The present invention can find application in diverse fields of engineering industries, such as ore-mining, metallurgical, construction, chemical, and abrasive industry.

It is known to use at present, cone crushers having an eccentric-type drive of the breaking head for disintegrating a variety of materials. Such crushers are known to comprise a shell carrying a crushing bowl with a breaking head accommodated in said bowl, and featuring its shaft connected to an eccentric mounted in the crusher shell. A serious disadvantage inherent in such crushers resides in a too low reduction ratio of the feed material which is as a rule not to exceed 3 to 5. Some studies have attributed said disadvantage to the aplication of the eccentric-type drive of the breaking head.

It is likewise known to use some prior-art inertia cone crushers featuring an out-of-balance type drive of the breaking head. They are known to comprise a shell interconnected with the base through spring-and-cable suspension gears. The shell carries a crushing bowl with a breaking head accommodated therein, and the breaking head incorporates a bearing-supported out-of-balance weight interconnected by a shaft running through the breaking head, with a universal-joint shaft. The shaft is coupled to a motor provided on the base above the crusher. Application of an out-of-balance weight as the drive of the breaking head allows one to overcome the cardinal disadvantage of the eccentric-driven cone crushers.

Inertia crushers are known to ensure a feed reduction ratio from 15 to 20 which is due to a greater number of gyrations of the breaking head per unit time. This, in turn, is accounted for by its ability to ride over the contact surface of the crushing bowl. Besides, in the inertia crushers the size of the crushed product varies but a little with the change of the clearance between the crushing surfaces of the head and bowl within the discharge zone of the crushing chamber, while any uncrushable solids entrapped along with the feed do not cause overloading of the crusher mechanism. Joining of the crusher shell with the base through spring-and-cable suspension gears makes it possible to dispense with special sturdy foundations for inertia crushers. However, said crushers have a rather short service life of the out-of-balance weight drive, and have a large overall crusher height of the crusher installation, and there are difficulties in providing for a regular and uniform charging of the crushing chamber, in replacing the crushing linings and repairing the crusher.

Most of said disadvantages have been eliminated in the inertia cone crusher according to the USSR Inventor's Certificate No. 405,580. The crusher comprises a shell interconnected with the base through vibration dampers and carrying a crushing bowl with a breaking head accommodated therein, the shaft of said head being coupled with a member carrying at its ends the unbalanced-weight vibrators which are interconnected through universal-joint shafts to the drive motors fixed in a stationary manner on the crusher base. This construction, though progressive as a whole, suffers from the disadvantage residing in unreliable drive of the unbalanced-weight vibrators resulting from the sophistication of the drive due to the provision of said member interconnecting the unbalanced-weight vibrators with the breaking head drive shaft.

From the standpoint of simplicity and reliability of the out-of-balance weight rotation drive, the most perfect is the inertia cone crusher as disclosed in the USSR Inventor's Certificate No. 419,240. The crusher is known to comprise a shell interconnected with the crusher base through vibration dampers and carrying a crushing bowl that accommodates a breaking head whose shaft carries an out-of-balance weight. Rotation is imparted to the latter from the driving member of the drive which is fixed in a stationary manner on the crusher base, through a ball spindle, provision being made in said spindle for a splined joint to compensate for vertical displacement of the crusher with respect to its base. The out-of-balance weight is axially supported by a rod running through the breaking head shaft and the weight being suspended on said rod. Such a constructional arrangement of the out-of-balance weight axial support proves to be the principal disadvantage of said crusher, as whenever it becomes necessary to dismantle the breaking head (in the case of wornout linings) the head has to be disassembled in situ, i.e., without being taken out from the crusher interior. This operation as a rule involves great difficulties and takes considerable time to perform which renders it impracticable to use a spare breaking head with a view to cutting down lost time. Another disadvantage of said crusher resides in the fact that an excess play in the out-of-balance weight bearing results in bending of the rod which serves as the axial support, said bending being aggravated by the forces of inertia. This fact makes the axial support of the out-of-balance weight insufficiently reliable.

A principal object of the present invention is to provide an inertia cone crusher, wherein the drive of an out-of-balance weight serves as an axial support thereof.

Another object of the present invention is to increase the reliability of the axial support of the out-of-balance weight.

One more object of the invention is to provide an inertia cone crusher, wherein easy dismantling of the breaking head would be ensured.

These objects are accomplished by an inertia cone crusher, comprising a shell proper interconnected through vibration dampers to the crusher base and carrying a crushing bowl that accommodates a breaking head, the shaft of said head carrying an out-of-balance weight provided with an axial support and a drive for performing rotary motion. A rotation drive for the out-of-balance weight including a countershaft mounted inside the crusher shell, and said countershaft with one of its ends is movably connected to the driving member, and with the other end said countershaft being joined with the out-of-balance weight through an axially immovable ball spindle, whereby the latter serves as an axial support for the out-of-balance weight.

According to one of the embodiments of the present invention, the countershaft is joined with the power driving member of the out-of-balance weight rotation drive through a ball-supported spindle.

Another embodiment of the present invention provides for the joining of the countershaft with said driving member through a flexible coupling.

In accordance with one more embodiment of the present invention, the countershaft is connected to said driving member through a universal-joint shaft.

The essence of the invention resides in the following.

With the axial support of the out-of-balance weight shaped as a ball spindle, torque can be transmitted from the latter to the former. This being the case, the ends of the ball spindle shaft must be spherically shaped for said shaft to rest with its spherical ends upon the spherical inserts which are housed in the top and bottom holders of the ball spindle. The shaft is joined with said holders through balls fitted in the spherical sockets of said shaft, said balls being adapted at the same time to engage the semicylindrical longitudinal slots of the holders. Thus, provision of the spherical shaft ends and the spherical inserts in the top and bottom holders for said shaft to rest upon, establishes a playfree joint, eliminates shaft bending and failure of the axial support under the effect of moving mass load.

Provision of a ball spindle as an axial support of the out-of-balance weight, which is at the same time capable of transmitting torque and is not coupled with the breaking head shaft, ensures easy dismantling of the latter.

The countershaft can be joined with the driving member of the out-of-balance weight rotation drive through a ball spindle which allows vertical displacement of the crusher shell with respect to its base due to, say, shifting of one of the spindle shaft ends with the balls inside the holder with elongate longitudinal slots. Besides, the countershaft can be connected to the driving member of the out-of-balance weight rotation drive through a flexible coupling or a universal-joint shaft provided with two Hooke's joints and a splined connection which allow both axial and radial displacements of the shafts.

For a better understanding of the essence of the present invention, the drawings of a specific and preferred embodiment of an inertia cone crusher according to the invention, are attached to a detailed disclosure thereof. In the drawings.

Figure 1:
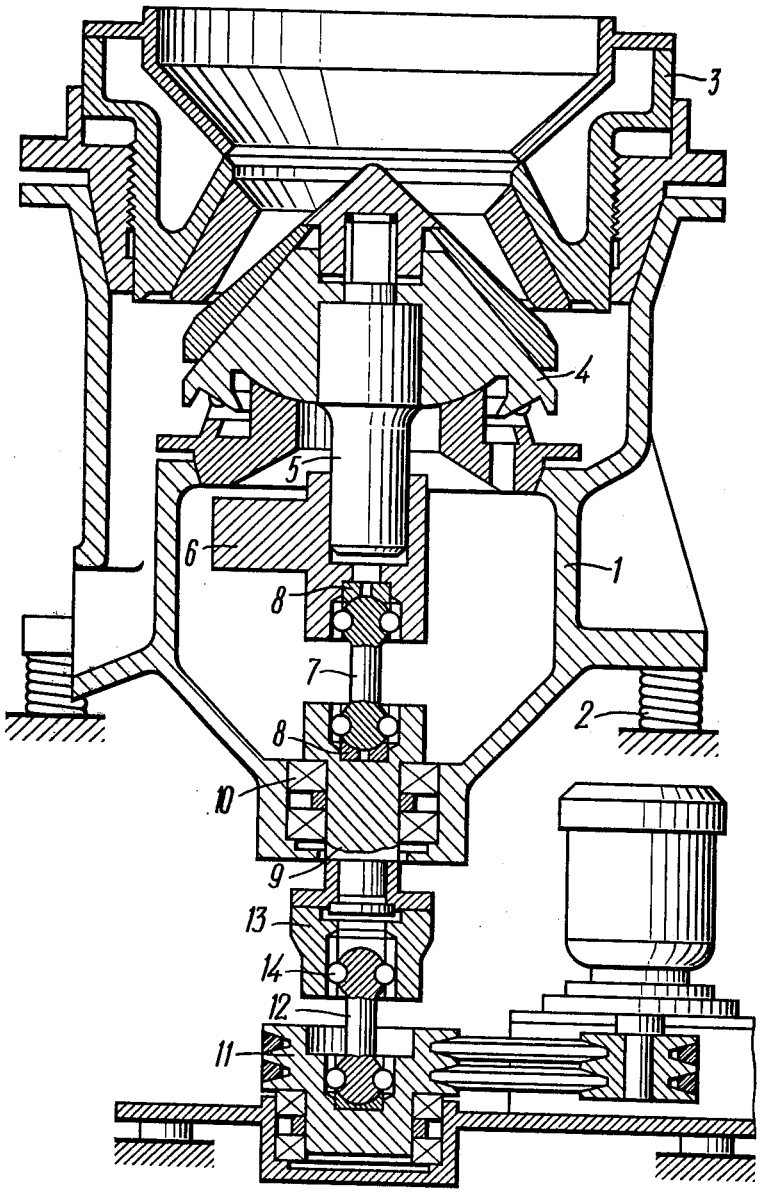
FIG. 1 is a longitudinal sectional view of an inertia cone crusher.

Referring now to the accompanying drawings, and in particular FIG. 1, the inertia cone crusher comprises a shell 1 interconnected with the crusher base through vibration dampers 2 and carrying a crushing bowl 3 which accommodates a breaking head 4. A shaft 5 of the breaking head 4 is seated in the bearing of an out-of-balance weight 6 which rests upon a ball spindle 7 having spherical inserts 8. The bottom of the ball spindle 7 is housed in a countershaft 9 which is adapted to take up thrusts from the ball spindle 7. The countershaft 9, in turn, relays the load through bearings 10 upon the shell 1, wherein said shaft is mounted. The countershaft 9 with its bottom portion is movably connected (both axially and radially) to the driving member 11 of the rotation drive of the out-of-balance weight 6. Said connection can be effected in various ways.

FIG. 1 illustrates the joining of the countershaft 9 with the driving member 11 through a ball spindle 12 whose holder 13 interconnected with the countershaft 9 is made oblong so as to render the shaft end of the ball spindle 12 with balls 14 housed in said holder axially movable. Besides, the shafts of the spindles 7, 12 can be joined with the holders thereof through other than the ball joints now in common use.

Figure 2:
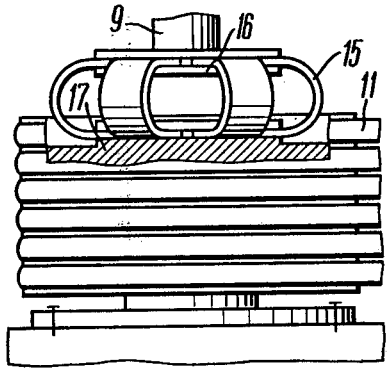
FIG. 2 illustrates in elevational view the connection of the countershaft to the driving member of the out-of-balance rotation drive, which is in fact a flexible coupling.

Furthermore, the countershaft 9 can be interconnected with the driving member 11 through a flexible coupling (FIG.2) made of elastic, thin flat parts or elements 15 fixed to a flange 16 of the countershaft 9 and to a flange 17 of the driving member 11. The elastic, thin flat parts or elements 15 of said coupling allow the countershaft 9 and the driving member 11 to move both axially and radially with respect to each other.

Figure 3:
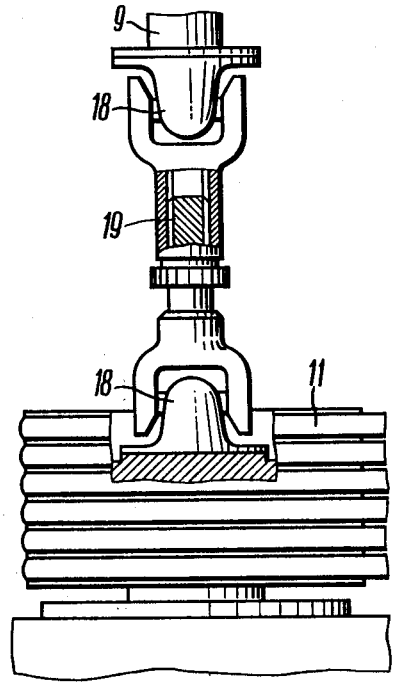
FIG. 3 shows another similar elevational view connection implemented as a universal-joint shaft.

Besides the countershaft 9 can be connected to the driving member 11 through a universal-joint shaft (FIG. 3) incorporating two Hooke's joints 18 interconnected through a splined joint 19. The latter is adapted to provide an axially movable connection of the countershaft 9 to the driving member 11.

The inertia cone crusher described hereinbefore operates as follows.

Rotation is translated from the driving member 11 to the ball spindle 12, wherefrom it is imparted through the countershaft 9 to the ball spindle 7 which in turn rotates the out-of-balance weight 6 and serves as the axial support for the latter. Rotation of the out-of-balance weight 6 develops a centrifugal force which acts upon the shaft 5 of the breaking head 4. Such centrifugal force causes the breaking head 4 to deflect until its crushing surface contacts that of the crushing bowl 3 and ride over the concave surface of the latter at a speed equal to the rotational speed of the out-of-balance weight 6. When riding over the crushing bowl the breaking head 4 develops its own centrifugal force. The feed entering the crushing chamber confined between the crushing surfaces of the breaking head 4 and those of the crushing surfaces of the breaking head 4 and those of the crushing bowl 3, is subjected to disintegration under the action of the centrifugal forces developed by the out-of-balance weight 6 and the breaking head 4. The latter rides over a layer of the feed material whose thickness depends upon the magnitude of said centrifugal forces and upon the physico-mechanical (size, strength, etc.) characteristics of the feed under crushing.

Under the action of the centrifugal forces produced by the out-of-balance weight 6 and the breaking head 4 the crusher shell 1 performs gyrations in phase opposition to the gyrations performed by the "breaking head-out-of-balance weight" system. The amplitude of gyrations of the shell 1 is the function of the geometrical parameters of the shell 1 on the one hand, and by those of the breaking head 4 and the out-of-balance weight 5, on the other. The geometrical parameters are to be understood herein as the masses of the shell, breaking head and out-of-balance weight, as well as the moments of inertia and static moments of said masses. The effect of vibrational loads upon the crusher base is prevented by means of the vibration dampers 2.

Figure 4:
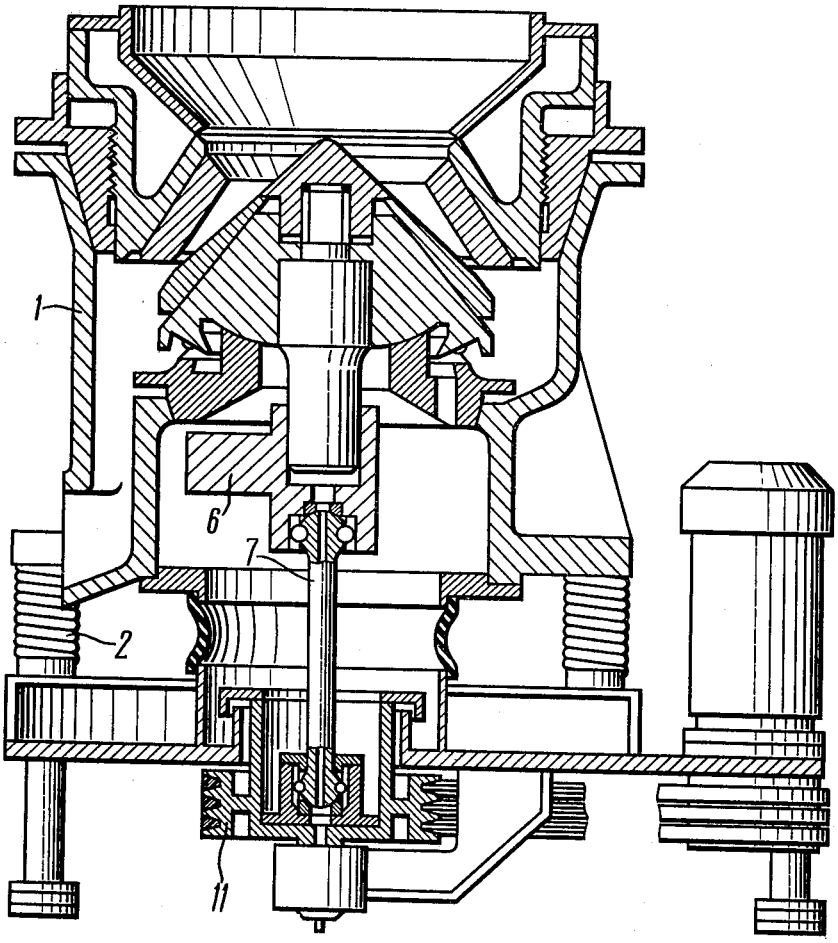
FIG. 4 represents a longitudinal sectional view of an inertia cone crusher, wherein the ball spindle serves as an axial support for the out-of-balance weight, and is coupled immediately to the driving member of the out-of-balance weight rotation drive.

We have also established that the aforementioned effect may as well occur in the case where the ball spindle 7 which is in fact an axial support for the out-of-balance weight 6, is coupled immediately to the driving member 11 of the out-of-balance weight rotation drive (FIG. 4). This being the case, the axial thrust exerted upon the crusher shell 1 from the system "out-of-balance weight — out-of-balance weight rotation drive" system is balanced by the crusher mass and by the axial rigidity of the vibration dampers 2 interconnecting the crusher shell 1 with its base.

It should be noted, however, that when the mass of the shell 1 is insufficient, this might result in an increased amplitude of the shell 1. If it is the case, it is recommended that use be made of the construction illustrated in FIG. 1.

Thus, the present invention can be applied to good advantage in all those fields of engineering industries which make use of devices ensuring fractional disintegration of various materials.

What is claimed is:

1. An inertia cone crusher comprising: a shell; vibration dampers adapted for connecting said shell with a base; a crushing bowl mounted in the top portion of said shell for receiving material to be fed therein for crushing same; a breaking head with a cantilevered shaft extending downwardly, said breaking head being mounted in said crushing bowl for crushing the material entering the bowl; an unbalanced weight set on said cantilevered shaft of the breaking head; a rotation drive for said unbalanced weight having a driving member disposed on the base under said shell coaxially with the latter, a countershaft mounted under said unbalanced weight in the bottom portion of said shell coaxially with the latter, a flexible connection for connecting the lower end of said countershaft with said driving member, and a ball spindle intended for connecting the upper end of said countershaft with said unbalanced weight and mounted in such a way as to serve as an axial support for said unbalanced weight.

2. A crusher according to claim 1, wherein said flexible connection for connecting the lower end of the countershaft with the driving member of the drive comprises a ball spindle.

3. A crusher according to claim 1, wherein said flexible connection for connecting the lower end of the countershaft with the driving member of the drive comprises two universal joints interconnected by a shaft.

4. A crusher according to claim 1, wherein said flexible connection for connecting the lower end of the countershaft with the driving member of the drive comprises an elastic coupling.

* * * * *

UNITED STATES PATENT OFFICE
CERTIFICATE OF CORRECTION

PATENT NO. : 4,073,446

DATED : February 14, 1978

INVENTOR(S) : Konstantin Alexandrovich Rundkvist, et al

It is certified that error appears in the above-identified patent and that said Letters Patent are hereby corrected as shown below:

On the first page, left-hand column, line 30, the U.S.S.R. Foreign Application Priority Data, change "1422777" to --2175958--.

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*